US007768248B1

(12) United States Patent
Hyde

(10) Patent No.: US 7,768,248 B1
(45) Date of Patent: Aug. 3, 2010

(54) DEVICES, SYSTEMS AND METHODS FOR GENERATING REFERENCE CURRENT FROM VOLTAGE DIFFERENTIAL HAVING LOW TEMPERATURE COEFFICIENT

(75) Inventor: John D. Hyde, Seattle, WA (US)

(73) Assignee: Impinj, Inc., Seattle, WA (US)

( * ) Notice: Subject to any disclaimer, the term of this patent is extended or adjusted under 35 U.S.C. 154(b) by 350 days.

(21) Appl. No.: 11/981,397

(22) Filed: Oct. 30, 2007

Related U.S. Application Data

(60) Provisional application No. 60/855,595, filed on Oct. 31, 2006.

(51) Int. Cl.
*G05F 3/16* (2006.01)

(52) U.S. Cl. ..... 323/315; 327/513; 327/543

(58) Field of Classification Search ..... 323/312–316, 323/282, 304, 267–269, 280; 327/53, 61, 327/67, 393, 545, 513; 365/208, 185.14, 365/189.07

See application file for complete search history.

(56) References Cited

U.S. PATENT DOCUMENTS

| | | | | |
|---|---|---|---|---|
| 5,512,814 | A * | 4/1996 | Allman | 323/267 |
| 5,635,869 | A | 6/1997 | Ferraiolo et al. | 327/543 |
| 5,841,270 | A | 11/1998 | Do et al. | 323/314 |
| 5,903,141 | A | 5/1999 | Tailliet | 323/312 |
| 6,052,020 | A * | 4/2000 | Doyle | 327/539 |
| 6,448,844 | B1 | 9/2002 | Cho | 327/538 |
| 6,813,209 | B2 * | 11/2004 | Crain et al. | 365/208 |
| 7,005,839 | B2 * | 2/2006 | Wada | 323/316 |

* cited by examiner

*Primary Examiner*—Rajnikant B Patel
(74) *Attorney, Agent, or Firm*—Turk IP Law, LLC

(57) ABSTRACT

Embodiments of the invention describe a reference current generator circuit having a core circuit that includes a first transistor in a first current path for conduct a first current and a second transistor in a second current path for conduct a second current. The second transistor has a threshold voltage that is different from the threshold voltage of the first transistor by at least 10%. The voltage differential between the first and second transistors generate a voltage across a resistive component coupled in series with the second transistor in the second current path.

14 Claims, 12 Drawing Sheets

CORE CIRCUIT WITH AMPLIFIER-BASED BIAS CIRCUIT

PRIOR ART REFERENCE CURRENT GENERATOR CIRCUIT

*VOLTAGE RESPONSES TO TEMPERATURE CHANGE IN PRIOR ART REFERENCE CURRENT GENERATOR*

REFERENCE CURRENT GENERATION CIRCUIT

*VOLTAGE RESPONSES TO TEMPERATURE CHANGE IN CURRENT REFERENCE CIRCUIT*

CORE CIRCUIT OF REFERENCE CURRENT GENERATION CIRCUIT

CORE CIRCUIT WITH AMPLIFIER-BASED BIAS CIRCUIT

CORE CIRCUIT WITH AMPLIFIER-BASED BIAS CIRCUIT

CORE CIRCUIT WITH AMPLIFIER-BASED BIAS CIRCUIT

REFERENCE CURRENT GENERATION CIRCUIT WITH MULTIPLE OUTPUT SIGNALS

RFID SYSTEM

RFID TAG

METHOD

DEVICES, SYSTEMS AND METHODS FOR GENERATING REFERENCE CURRENT FROM VOLTAGE DIFFERENTIAL HAVING LOW TEMPERATURE COEFFICIENT

CROSS REFERENCE TO RELATED PATENT APPLICATIONS

This patent application claims priority from U.S. Provisional Patent Application No. 60/855,595, filed on Oct. 31, 2006, the disclosure of which is hereby incorporated by reference for all purposes.

This patent application may be found to be related to U.S. patent application Ser. No. 11/981,396 titled "DEVICES AND METHODS FOR GENERATING REFERENCE CURRENT HAVING LOW TEMPERATURE COEFFICIENT DEPENDENCE", by the same inventor, due to be assigned to the same assignee, and originally filed with the U.S. Patent Office on the same day as the instant application.

BACKGROUND

1. Field of the Invention

The present description is related to the field of integrated circuits, and more specifically to devices, systems, and methods for generating a reference current from a voltage differential having a low temperature coefficient.

2. Description of the Related Art

A number of integrated circuits require a current reference for biasing various operations. For example, Radio Frequency IDentification (RFID) systems may be integrated circuits, and typically include RFID tags and RFID readers. RFID readers are also known as RFID reader/writers or RFID interrogators. RFID systems can be used in many ways for locating and identifying objects to which the tags are attached. In earlier RFID tags, the power management section included an energy storage device, such as a battery. RFID tags with an energy storage device are known as active tags. Advances in semiconductor technology have miniaturized the electronics so much that an RFID tag can be powered solely by the RF signal it receives. Such RFID tags do not include an energy storage device, and are called passive tags.

RFID systems are particularly useful in product-related and service-related industries for tracking large numbers of objects being processed, inventoried, or handled. In such cases, an RFID tag is usually attached to an individual item, or to its package.

In principle, RFID techniques entail using an RFID reader to interrogate one or more RFID tags. The reader transmitting a Radio Frequency (RF) wave performs the interrogation. A tag that senses the interrogating RF wave responds by transmitting back another RF wave. The tag generates the transmitted back RF wave either originally, or by reflecting back a portion of the interrogating RF wave in a process known as backscatter. Backscatter may take place in a number of ways.

The reflected-back RF wave may further encode data stored internally in the tag, such as a number. The response is demodulated and decoded by the reader, which thereby identifies, counts, or otherwise interacts with the associated item. The decoded data can denote a serial number, a price, a date, a destination, other attribute(s), any combination of attributes, and so on.

RFID tags may include a number of circuits, analog or digital, that are biased by a current reference. Reference current generators in integrated circuits, such as the RFID system, may be designed a number of ways known in the art. Prior art reference current generators typically generate currents that are proportional to absolute temperature ("PTAT"), and therefore currents that increase as temperature increases.

FIG. 1 is a diagram of a prior art reference current generator circuit 123 that includes a bias circuit 110 for providing drain currents to a pair of NMOS transistors 114 in a current mirror configuration. Reference currents are generated by the reference current generator circuit 123 by coupling a P-type mirror circuit 121P and an N-type mirror circuit 121N to each of the respective drains of the transistors 114 at nodes 113 and 117.

More specifically, the bias circuit 110 includes a pair of PMOS transistors 112, sourced by a voltage supply VDD, whose gates are coupled to each other and to the drain of one of the transistors 112 at node 113. Each of the drains of the transistors 112 are coupled to the drains of the transistors 114, whose gates are coupled to each other and to the drain of one of the transistors 114 at the node 117. Therefore, the drain current through the node 117 determines the gate-to-source voltage for both devices. The sources of the transistors 114 are coupled to ground, one of which is coupled to ground through a resistor 116. The transistor 114 coupled to node 113 is designed to have a smaller gate-to-source voltage than the transistor 114 coupled to node 117. The voltage differential between the gate-to-source voltages of the transistors 114 is thus the voltage across the resistor 116. The transistors 114 are similar devices and typically designed to have the same threshold voltage $V_{T1}$. Because the transistors 114 have the same threshold voltage, the devices differ in size or current density to create the voltage differential necessary to provide the voltage drop across the resistor 116. The resulting resistor current through the resistor 116 is mirrored by the bias circuit 110 to determine the drain currents through the nodes 113, 117.

As current passes through the transistors 114, voltages $V_{PGATE}$ and $V_{NGATE}$ at nodes 113, 117 may respectively be used to drive one or more mirror circuits 121P, 121N for generating the reference currents. For example, a PMOS transistor 132 in the mirror circuit 121P may be biased by the $V_{PGATE}$ voltage at node 113 to generate a reference current $I_{PREF}$ sourced from VDD. Similarly, an NMOS transistor 134 in the mirror circuit 121N may be biased by the $V_{NGATE}$ voltage to generate another reference current $I_{NREF}$. The $I_{PREF}$ and $I_{NREF}$ currents may be used to bias other circuitry, for example, components in the RFID system.

A problem with the prior art reference current generator circuit 123, however, is that the generated reference current increases as temperature increases due to the currents being directly proportional to temperature. As a result, the current references generated by the prior art reference current generator 123 may vary by more than 45% between a wide range of temperatures −40° C. to +65° C.

FIG. 2 is an illustration of the signal responses of the transistors 114 to temperature changes (ranging between −40° C. to 90° C.) in the prior art reference current generator circuit 123 of FIG. 1. An upper signal diagram 240 shows the gate-to-source voltage of the transistor 114 coupled to node 117 as a function of the drain current. A middle signal diagram 250 shows the gate-to-source voltage of the transistor 114 coupled to node 113 as a function of the drain current. In both cases, an increase in temperature causes the gate-to-source voltages of devices such as the transistors 114 to decrease, as is well known in the art. In the upper signal diagram 240, the gate-to-source voltage at a lower temperature −40° C., shown as a signal 245, decreases as the temperature increases to 25° C., shown as a signal 247. The more the temperature increases, the voltage continues to decrease, as shown by the current signal 249 at the higher temperature 90° C. At any given drain current in the middle signal diagram 250, the gate-to-source voltage is less than the gate-to-source voltage at the corresponding drain current in the upper signal diagram 240 so that the difference between the gate-to-source voltage creates the necessary voltage drop across the resistor 116.

Lowering the current density, however, causes a greater gap, as temperature increases, in the spacing between the gate-to-source voltage signals 255-259 of the middle signal diagram 250, as compared to the signals 245, 247, 249 of the upper signal diagram 240. Consequently, the change in voltage difference between the signal 255 at the temperature −40° C. and the signal 257 at the temperature 25° C. is greater than the corresponding voltage/temperature signals 245, 247 of the upper signal diagram 240. Because essentially identical transistors 114 are used, and because the transistors 114 are biased at different current densities to have different gate-to-source voltages, thus creating the voltage drop across the resistor 116, the transistors 114 have different temperature coefficients. Therefore, the same difference between transistors 114 to create the voltage differential creates a difference in the temperature variation between the signals of the upper signal diagram 240 and the middle signal diagram 250. Thus the voltage across the resistor 116 is shown in a lower signal diagram 260 to have PTAT characteristics, where the voltage represented by signals 265, 267, 269 increase as the temperature increases from −40° C. to 25° C. and 90° C., respectively.

A consequence of creating the voltage drop across the resistor 116 in the prior art reference current generator circuit 123 is the undesirable increase in the resistor voltage as temperature increases. As a result, the prior art reference current generator circuit 123 provides reference currents that are temperature dependent. The high current variation of the reference currents (by 45%) increases power consumption and degrades performance. For example, sensitivity is a critical parameter particularly in RFID systems, since passive tags rely on power from readers antennas to operate. Any undesirable variation in the reference current due to temperature, and thus an increase in power consumption, limits the reliability and performance of RFID tags.

There is therefore a need for a reference current generator circuit having currents with substantially the same temperature coefficient such that the temperature variation of the voltage differential is reduced and a reference current may be generated that maintains a substantially constant current over a wide range of temperatures.

BRIEF SUMMARY

The present description gives instances of a reference current generator circuits, devices, systems, and methods, the use of which may help overcome these problems and limitations of the prior art.

In one optional embodiment, a reference current generator circuit includes a core circuit having a first transistor in a first current path for conduct a first current. The first transistor has a first threshold voltage. The core circuit includes a second transistor in a second current path for conduct a second current. The second transistor has a second threshold voltage different by at least 10% from the first threshold voltage of the first transistor. Thus a voltage differential is created to generate a voltage across a resistive component coupled in series with the second transistor in the second current path.

An advantage over the prior art is that threshold voltage difference allows the temperature coefficients of the first and second transistors to be substantially the same, thereby generating a voltage across the resistive component that is substantially independent of temperature variation.

These and other features and advantages of this description will become more readily apparent from the following Detailed Description, which proceeds with reference to the drawings, in which:

DETAILED DESCRIPTION

As has been mentioned, the present description is about devices, systems, and methods for generating a reference current from a voltage differential having a low temperature coefficient. The subject is now described in more detail.

Certain details are set forth below to provide a sufficient understanding of the embodiments of the invention. However, it will be clear to one skilled in the art that the invention may be practiced without these particular details. Moreover, the particular embodiments of the present invention described herein are provided by way of example and should not be used to limit the scope of the invention to these particular embodiments. In other instances, well-known circuits, control signals, timing protocols, and software operations have not been shown in detail in order to avoid unnecessarily obscuring the embodiments of the invention.

Figure 3:
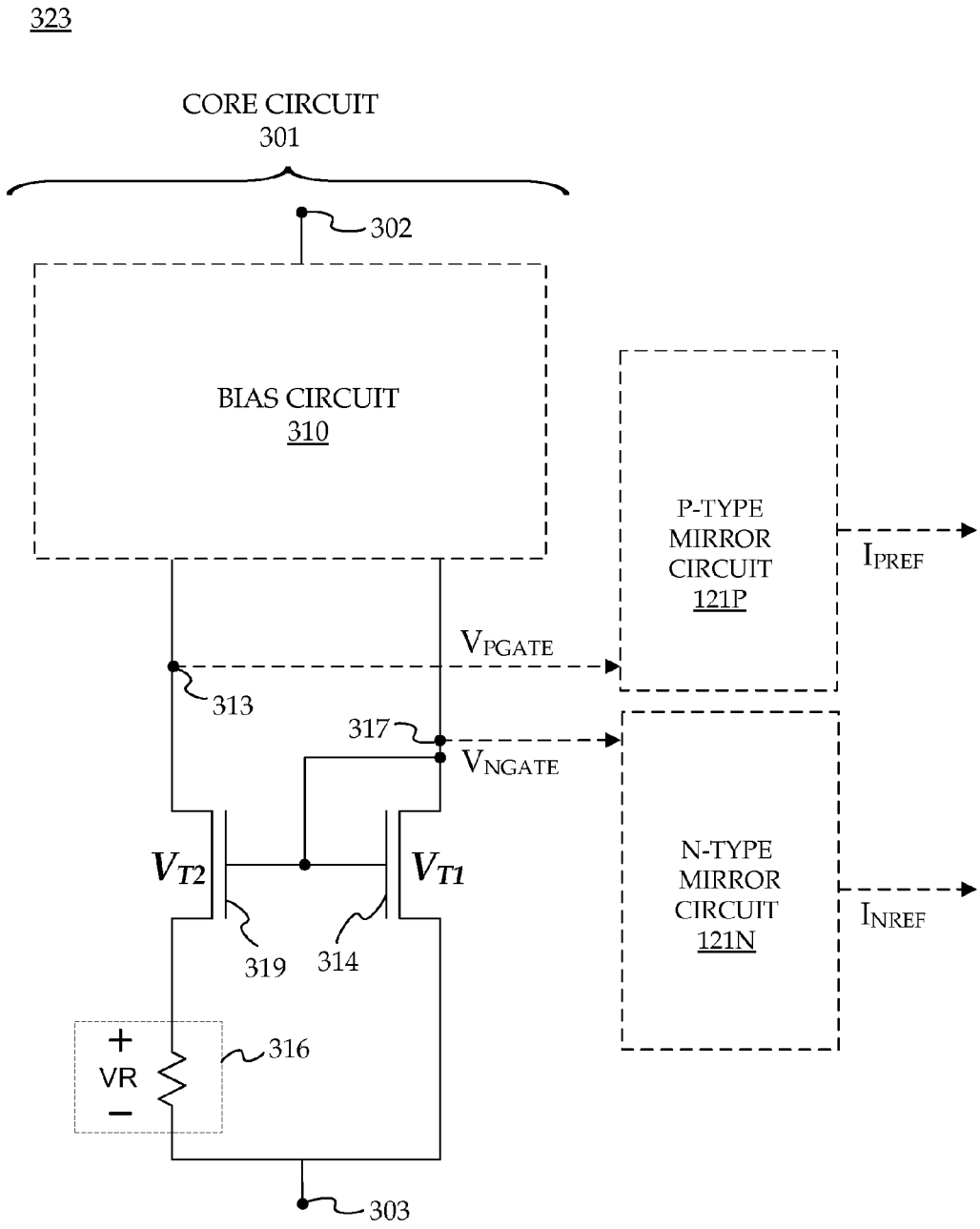
FIG. 3 is a schematic diagram of a reference current generation circuit according to embodiments.

FIG. 3 is a diagram of a reference current generator circuit 323 according to an embodiment of the invention. The reference current generator circuit 323 includes some of the same components as the reference current generator circuit 123 of FIG. 1. In the interest of brevity, those same components have been given the same reference numerals and will not be described again.

The reference current generator circuit 323 includes a core circuit 301 for sourcing a current independent of temperature variations. The core circuit 301 is coupled between two nodes 302, 303. Each of nodes 302, 303 may be coupled to a voltage supply. Slave current circuits, such as the P-type and N-type mirror circuits 121P, 121N may reference the current in the core circuit 301 to generate reference currents that are also independent of temperature variations. The core circuit 301 may be implemented with other circuit components and hardware in any number of ways as will be apparent to a person skilled in the art in view of the present description.

In one such embodiment, the core circuit 301 includes an input node 317 coupled to the drain and gate of a transistor 314 whose source may be coupled to a negative voltage supply at node 303. Thus, the input node 317 may be adapted to receive a current sourced through the transistor 314 towards the node 303. The core circuit 301 includes a second transistor 319 having a gate coupled to the gate of the first transistor 314 in a parallel configuration. It will be appreciated that the transistors 314, 319 may represent any number, type and combination of devices, one such type of device being NMOS transistors.

The source of the second transistor 319 is additionally coupled to the node 303 through a resistive component 316. The resistive component 316 may be a resistor, a transistor or any component known in the art to drive current towards the node 303. For example, among the resistor-types the resistive component 316 may be polysilicon resistor, a diffused resistor or an n-well resistor. It is desirable to have a resistor size of approximately one million ohms.

Figure 1:
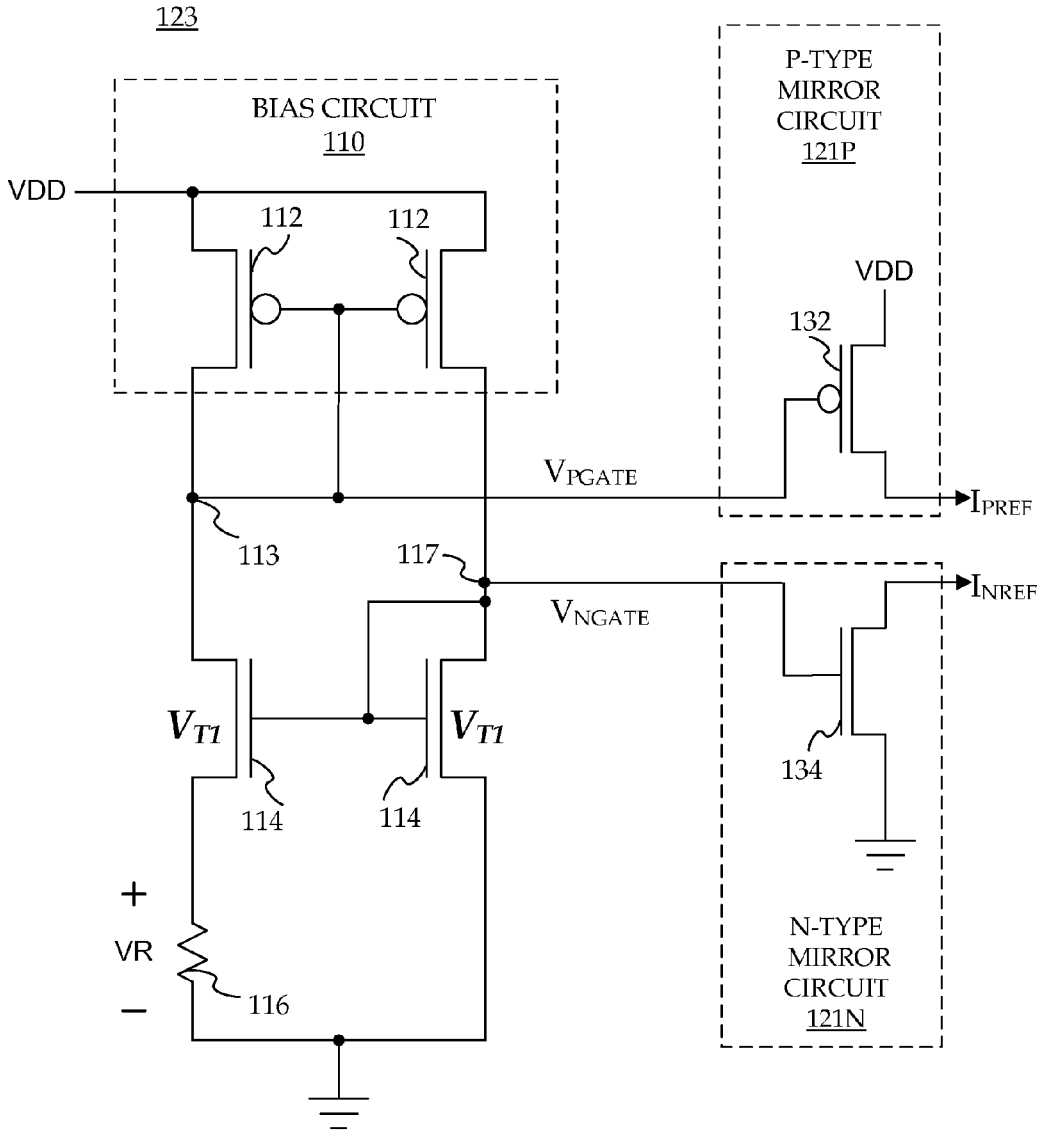
FIG. 1 (PRIOR ART)
FIG. 1 is a schematic diagram of a prior art reference current generation circuit.

Similar to the bias current of the prior art reference current generator 123 of FIG. 1, a voltage drop across the resistive component 316 may be created by having a voltage differential between the first transistor 314 and the second transistor 319, and thus generating current through the resistive component 319. To generate a current substantially independent of temperature variations, the voltage differential may be created having low temperature coefficient. The voltage differential in the core circuit 301 may be created by any number of circuit implementations, one such implementation is described further.

In contrast to the prior art current reference generator circuit 123, the transistors 314, 319 may be designed to have different threshold voltages $V_{T1}$, $V_{T2}$ such that each device has a different gate-to-source voltage to create the voltage differential by having transistors 314, 319. For example, the threshold voltage $V_{T2}$ of the second transistor 319 may be lower than the threshold voltage $V_{T1}$ of the first transistor by a different of at least 10%. Thus, the transistors 314, 319 may be designed to have the same temperature coefficient even though they have different gate-to-source voltages because of the different threshold voltages $V_{T1}$, $V_{T2}$. Therefore, if the temperature coefficient of the current through the transistor 314 is substantially the same as the temperature coefficient of the current through the transistor 319, the voltage drop across the resistive component 316 remains constant over temperature variations due to the voltage differential between the transistors 314, 316.

Figure 2:
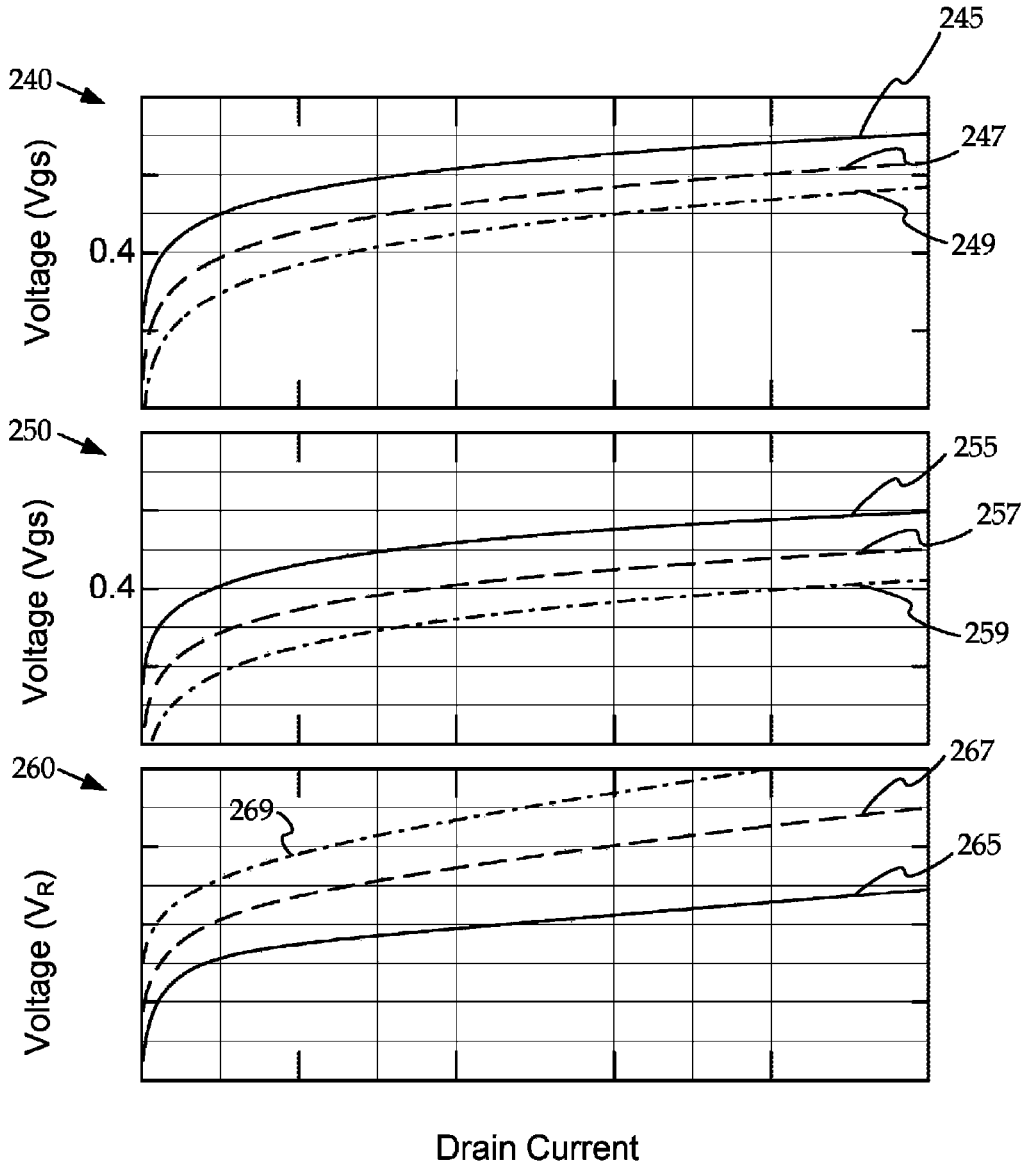
FIG. 2 (PRIOR ART)
FIG. 2 is a diagram showing signal responses to temperature changes of various components in the prior art reference current generation circuit of FIG. 1.
Figure 4:
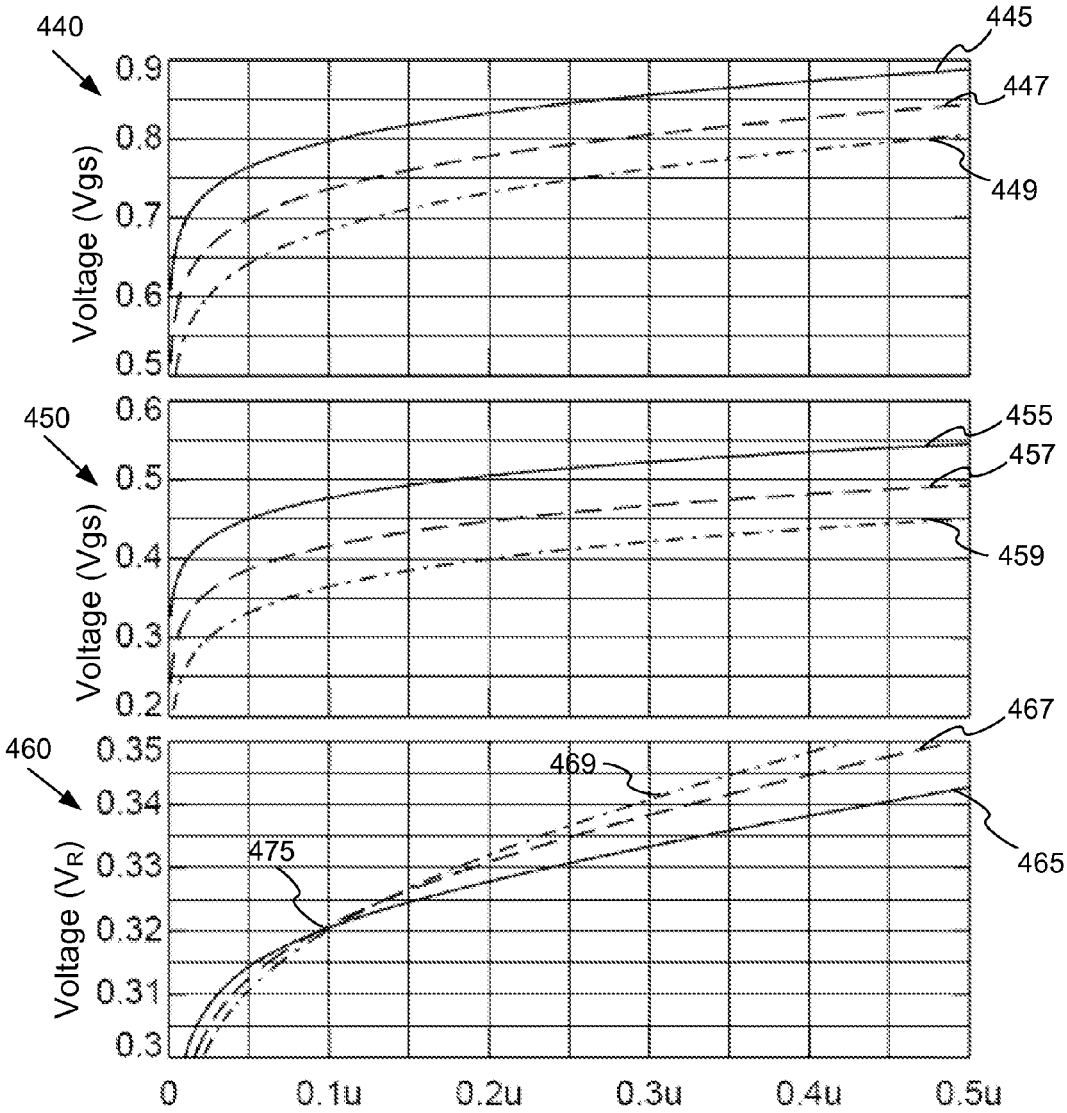
FIG. 4 is three diagrams showing voltage signal responses to temperature changes of various components in the current reference circuit of FIG. 3.

FIG. 4 includes three signal diagrams that show signal responses to a range of sampled temperatures (−40° C. to 90° C.) by the transistors 314, 319, having different threshold voltages $V_{T1}$, $V_{T2}$, and the resistive component 316. For illustration purposes, the example shown in FIG. 4 was drawn from voltage signals of transistors 314, 319 having a threshold voltage difference by at least 10%. An upper signal diagram 440 shows the temperature variation of the gate-to-source voltage of the first transistor 314 as temperature increases. A signal 445 represents the gate-to-source voltage of the first transistor 314 as a function of drain current at a low temperature of approximately ~40° C. As previously described with respect to FIG. 2, it is known in the art that the gate-to-source voltage decreases as temperature increases, as shown by a signal 447 responding to temperature increasing to approximately 25° C. A signal 449 represents the gate-to-source voltage dropping lower responsive to a higher temperature of approximately 90° C.

A middle signal diagram 450 shows that the gate-to-source voltage signals of the second transistor 319, represented by signals 455, 457, 459 respectively, are lower than gate-to-source-voltages signals 445, 447, 449 of the first transistor 314 shown in the upper diagram 440 at corresponding temperatures. Therefore a voltage differential is generated at each sampled temperature. However, the middle signal diagram 450 also indicates the gate-to-source voltage transitions of the transistor 319 have substantially the same temperature variations across corresponding temperature changes as compared to the gate-to-source voltage transitions of the first transistor 314 in the upper signal diagram 440. Thus, the temperature coefficient of the transistor 319 is substantially similar to the temperature coefficient of the transistor 314.

A lower signal diagram 460 of FIG. 4 represents the voltage drop across the resistive component 316 over corresponding sampled temperatures represented by signals 465, 467, 469, respectively. As previously explained, the voltage across the resistive component 316 is generated due to the gate-to-source voltage differences between the signals of the upper and lower signal diagrams 440, 450. In response to the similar transitions of the gate-to-source voltages of the transistors 314, 319, due to similar temperature coefficients, the voltage drop across the resistive component 316 at a predetermined operating point 475 (approximately 100 nA) remains constant, indicated by the signals 465, 467, 469 converging at the point 475.

Thus, the core circuit 301 of FIG. 3 allows the drain currents to pass through transistors 314, 319 substantially independent of temperature variation, evidenced by the substantially constant current at the predetermine operating point 475 over a range of temperatures. As a result, a relatively constant current is generated through the resistive component 316 at the operating point 475. The relatively constant current may be maintained over a temperature range of at least 30° C.

It will be appreciated that the various circuit components and parameters in FIGS. 3 and 4 are described for the purposes of illustrating an operation of the current reference generator circuit 323. Those ordinarily skilled in the art will obtain sufficient understanding from the description provided herein to make such modifications as needed to practice other embodiments as applied to the current reference generator circuit 323. Those ordinarily skilled in the art will also understand that in FIG. 3 and also the other embodiments that follow, NMOS transistors may be replaced with PMOS, and PMOS transistors may be replaced by NMOS, by changing the supply voltage polarity.

A bias circuit 310 may optionally be included in the core circuit 301 of FIG. 3 to provide one or more currents to the transistors 314, 319 through the nodes 313, 317. The bias circuit 310 may be one of any number of bias circuits known in the art. The bias circuit 310 may include a start-up circuit (not shown) to provide the initial current. Some of the embodiments will now be described with reference to FIGS.

5-8. The embodiments in FIGS. 5-8 may share some of the same components as the reference current generator circuit 323 of FIG. 3. These same components are assigned the same reference numerals, and in the interest of brevity, these same components will not be described again.

Figure 5:
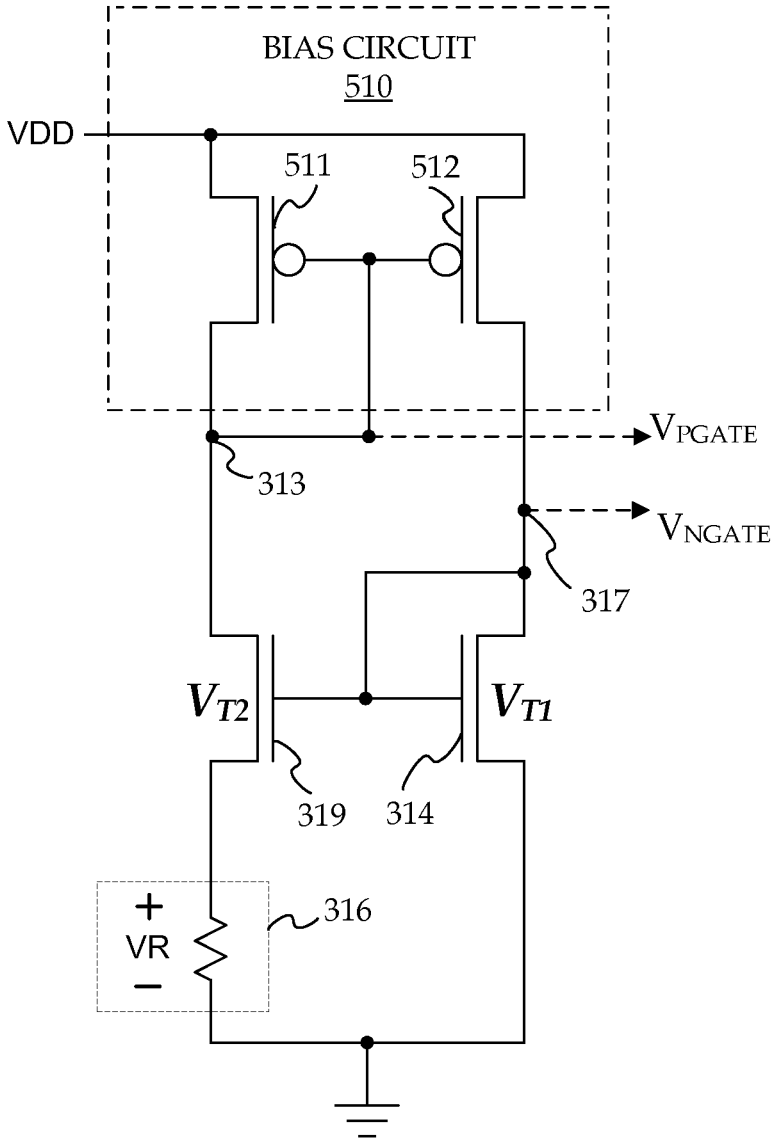
FIG. 5 is a schematic diagram of a core circuit of a reference current generation circuit according to an embodiment.

FIG. 5 shows a core circuit 501 that includes a bias circuit 510 according to one embodiment. The bias circuit 510 includes a pair of PMOS transistors 511, 512 coupled to each other at the gates and biased by the drain of the transistor 511 at the node 313. The sources of the transistors 511, 512 are coupled to a voltage supply VDD. The transistors 511, 512 may be the same devices, thus ensuring the currents through the transistors 314, 319 are the same.

Alternatively, the transistors 511, 512 may be configured to have different parameters, such as size and type, to change the ratio between the currents through the first transistor 314 and the second transistor 319. Thus, the gate-to-source voltage differential between the transistors 314, 319 may be created by using transistors 511, 512 having different parameters. Additionally, different reference currents may be generated from $V_{PGATE}$ and $V_{NGATE}$ at nodes 313, 317 for circuitry that may require different amounts of current, but that are substantially independent of temperature variations.

Figure 6:
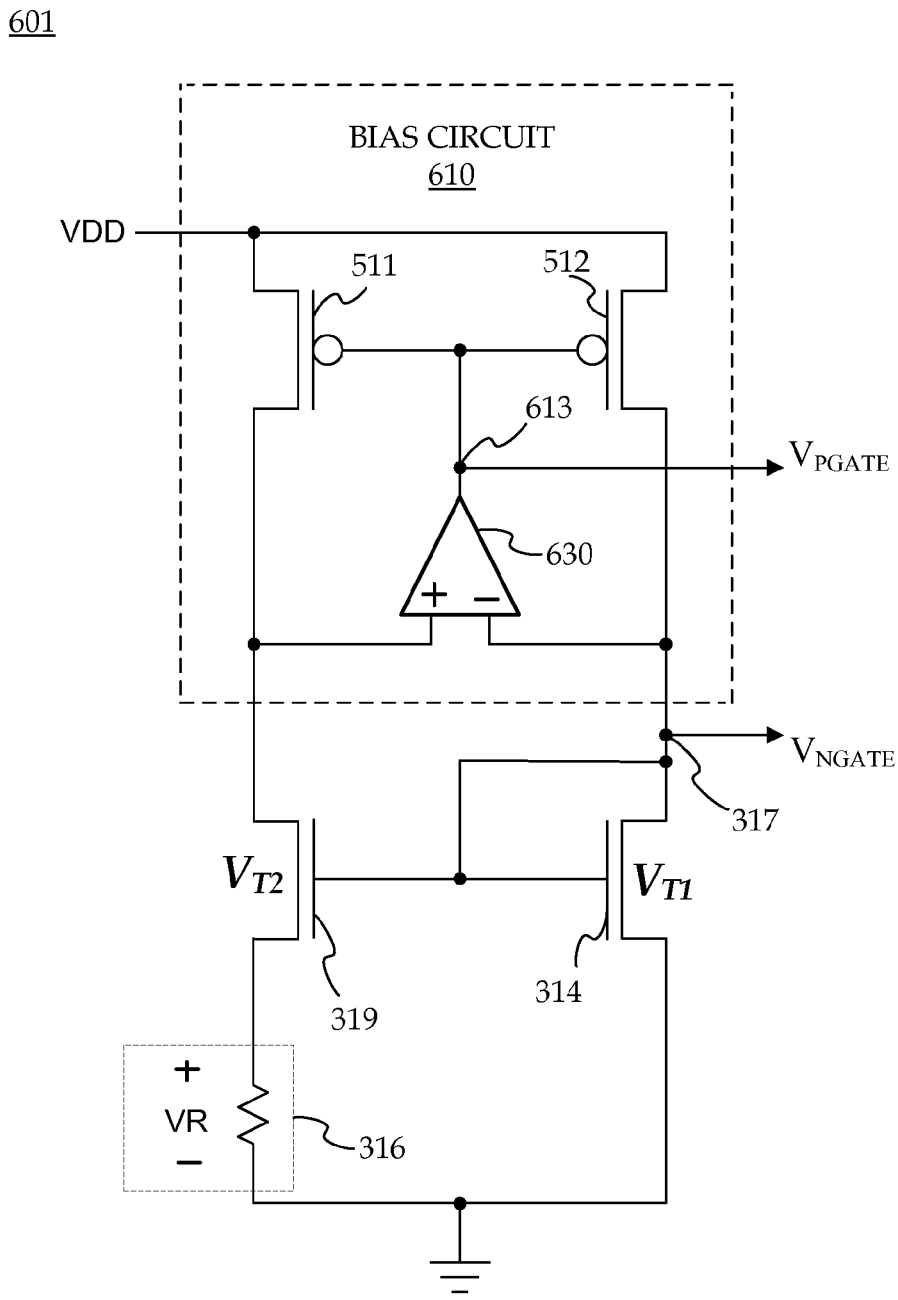
FIG. 6 is a schematic diagram of a core circuit of a reference current generation circuit including a bias circuit containing an amplifier according to an embodiment.
Figure 7:
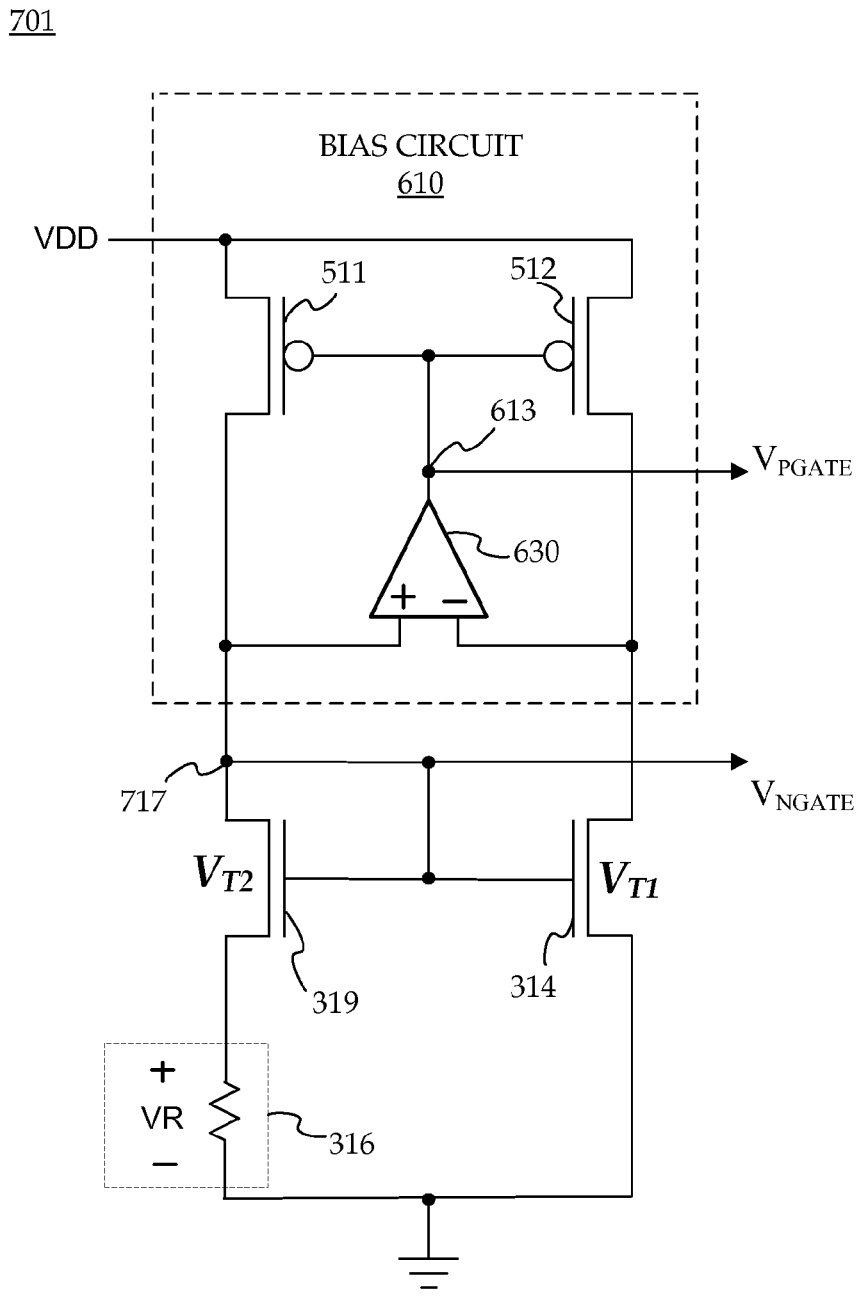
FIG. 7 is a schematic diagram of a core circuit of a reference current generation circuit including the bias circuit of FIG. 6 according to another embodiment.

FIGS. 6 and 7 show alternative embodiments of the bias circuit 510. FIG. 6 shows a bias circuit 610 in a core circuit 601 that optionally includes an amplifier circuit 630 to drive the PMOS transistors 511, 512 at a node 613. Amplifier circuits are common in the art, any number of which may be used as the amplifier circuit 630. The amplifier circuit 630 may additionally control the ratio between the currents through the transistors 314, 319 by adjusting the magnitudes of the respective currents. The amplifier circuit 630 receives voltage inputs at drain nodes of the transistors 511, 512. The output of the amplifier circuit 630 at node 613 may provide one of the output voltages $V_{PGATE}$, while the other output voltage $V_{NGATE}$ is accessible at the node 317, as in previous embodiments.

FIG. 7 shows a core circuit 701 that alternatively provides the output voltage $V_{NGATE}$ at a node 717 on the current path of the positive input of the amplifier circuit 630 and the resistive component 316. Therefore, the output voltage $V_{NGATE}$ may be accessed on either current paths of the core circuits 601, 701.

Figure 8:
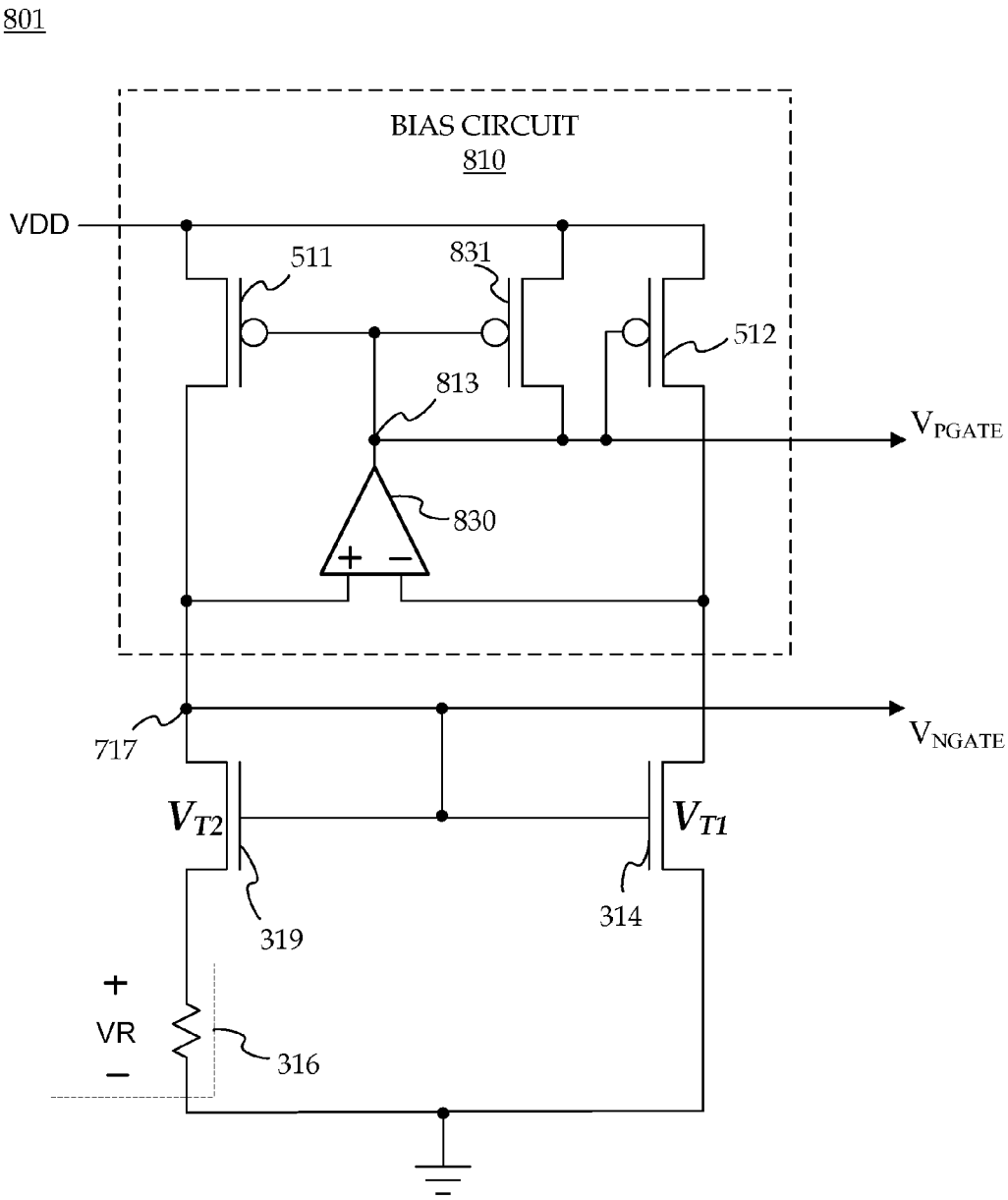
FIG. 8 is a schematic diagram of the core circuit of a reference current generation circuit including a bias circuit containing an amplifier according to yet another embodiment.

FIG. 8 shows, as another embodiment, a core circuit 801 having a bias circuit 810 that includes a transconductance amplifier 830. The transconductance amplifier 830 may be implemented in any way. One of the ways is shown with the transconductance amplifier 830 receiving voltage inputs from drain nodes of the transistors 511, 512. The transconductance amplifier 830 instead generates an output current through a node 813 to drive the transistors 511, 512. The output current may be converted to an output voltage $V_{PGATE}$ at node 813 by a third PMOS transistor 831, whose gate and drain are coupled to the node 813 and is biased by the output current.

Figure 9:
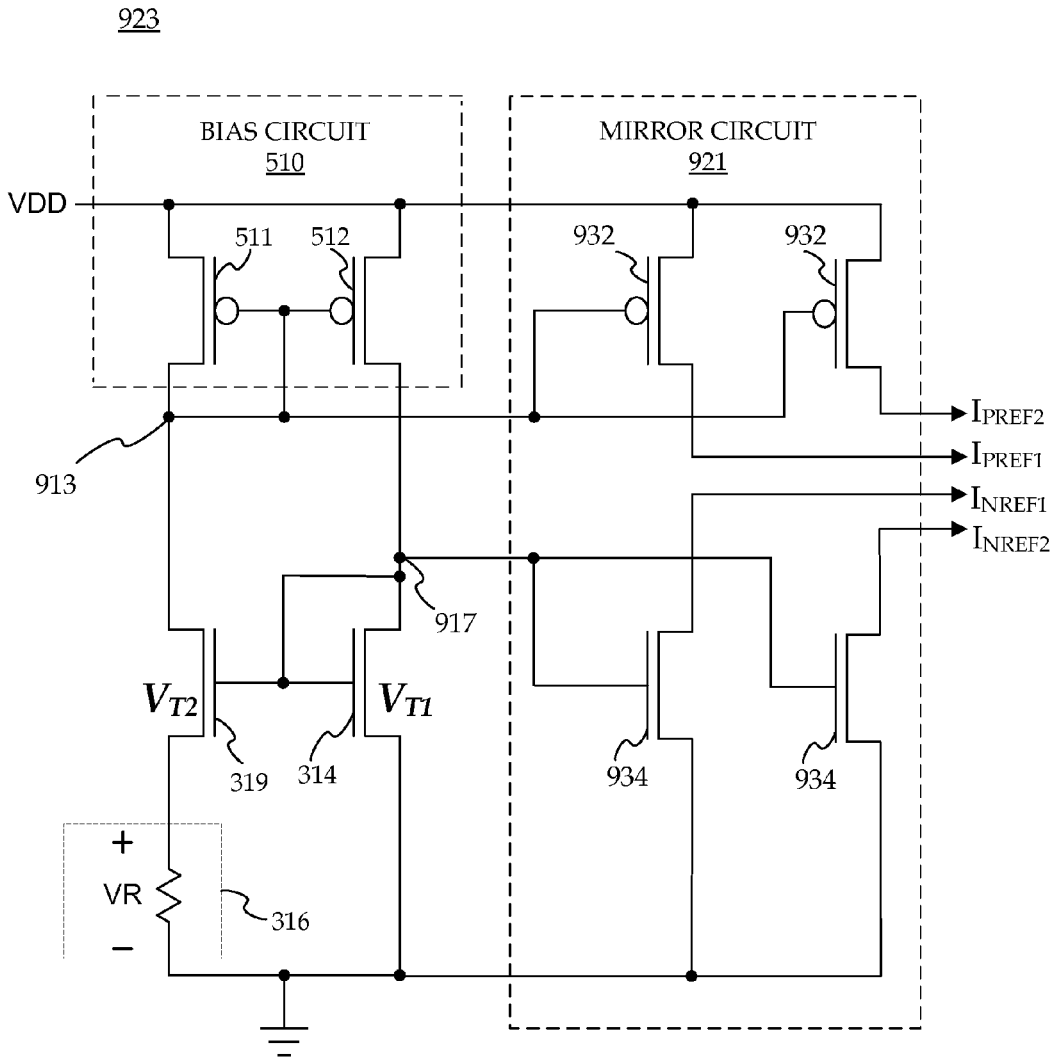
FIG. 9 is a schematic diagram of a reference current generation circuit having multiple output signals according to a further embodiment.

FIG. 9 is a diagram of a reference current generator circuit 923 that includes a mirror circuit 921 for generating one or more reference currents according to a further embodiment. The mirror circuit 921 may include one or more PMOS transistors 932 having gates coupled to a node 913. The voltage at the node 913 is used to bias the transistors 932 to generate one or more reference currents $I_{PREF1}$, $I_{PREF2}$ at the respective drains. The reference currents $I_{PREF1}$, $I_{PREF2}$ may be utilized to power external circuitry or devices.

The mirror circuit 921 may include one or more NMOS transistors 934 having gates coupled to a node 917. Similarly, the voltage at the node 917 may be used to bias the transistors 934 to generate one or more reference currents $I_{NREF1}$, $I_{NREF2}$, such that multiple reference currents can be generated.

The $I_{PREF1}$, $I_{PREF2}$, $I_{NREF1}$, $I_{NREF2}$ currents may be the same currents referenced to the currents through the first and second transistors 314, 319, respectively. Alternatively, as previously described, the $I_{PREF1}$, $I_{PREF2}$, $I_{NREF1}$, $I_{NREF2}$ currents may be different determined by transistor parameters that may be different between the transistors 314, 319, 511, 512.

Figure 10:
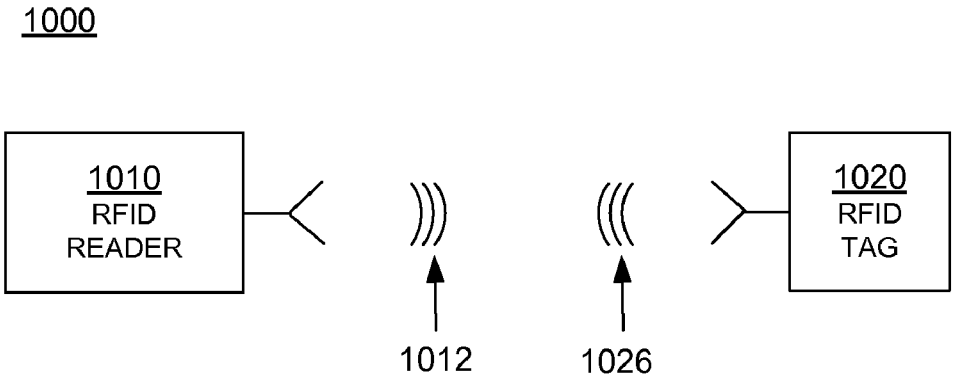
FIG. 10 is a block diagram of an RFID system having an RFID tag that includes a reference current generation circuit according to embodiments.

FIG. 10 is a diagram of components of a typical RFID system 1000, incorporating aspects of the invention. An RFID reader 1010 transmits an interrogating Radio Frequency (RF) wave 1012. RFID tag 1020 in the vicinity of RFID reader 1010 may sense interrogating RF wave 1012, and generate wave 1026 in response. RFID reader 1010 senses and interprets wave 1026.

Reader 1010 and tag 1020 exchange data via wave 1012 and wave 1026. In a session of such an exchange, each encodes, modulates, and transmits data to the other, and each receives, demodulates, and decodes data from the other. The data is modulated onto, and decoded from, RF waveforms.

Tag 1020 can be a passive tag or an active tag, i.e. having its own power source. Where tag 1020 is a passive tag, it is powered from wave 1012. Embodiment of the invention may be utilized in the tag 1020 to power various components of the tag 1020 with bias currents that are substantially independent of temperature variations. Less power is used, and sensitivity improved by using temperature regulated bias currents to control the amount of power used in the tag 1020.

Figure 11:
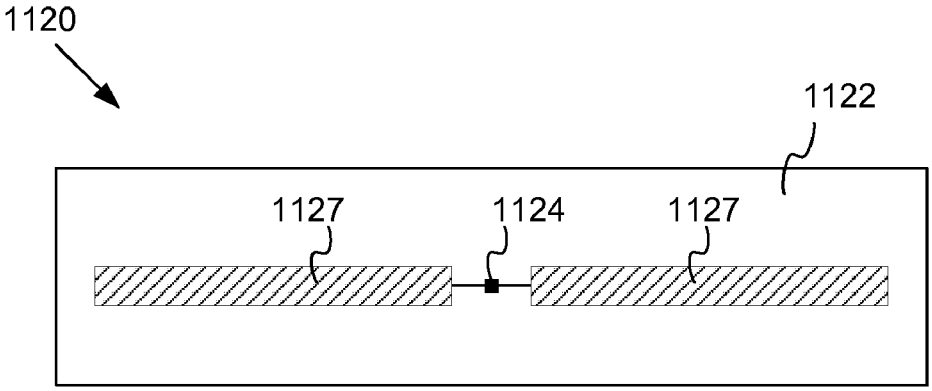
FIG. 11 is a diagram showing components of a passive RFID tag, such as the one shown in FIG. 10.

FIG. 11 is a diagram of an RFID tag 1120, which can be the same as tag 1020 of FIG. 10. Tag 1120 is implemented as a passive tag, meaning it does not have its own power source. It will be appreciated, however, that many of the embodiments previously described applies also to active tags.

Tag 1120 is formed on a substantially planar inlay 1122, which can be made in many ways known in the art. Tag 1120 includes an electrical circuit, which is preferably implemented in an integrated circuit (IC) 1124. IC 1124 is arranged on inlay 1122.

Tag 1120 also includes an antenna for exchanging wireless signals with its environment. The antenna is usually flat and attached to inlay 1122. IC 1124 is electrically coupled to the antenna via suitable antenna ports (not shown in FIG. 11).

The antenna may be made in a number of ways, as is well known in the art. In the example of FIG. 11, the antenna is made from two distinct antenna segments 1127, which are shown here forming a dipole. Many other embodiments are possible, using any number of antenna segments.

In some embodiments, an antenna can be made with even a single segment. Different places of the segment can be coupled to one or more of the antenna ports of IC 1124. For example, the antenna can form a single loop, with its ends coupled to the ports. When the single segment has more complex shapes, it should be remembered that at, the frequencies of RFID wireless communication, even a single segment could behave like multiple segments.

In operation, a signal is received by the antenna, and communicated to IC 1124. IC 1124 both harvests power, and responds if appropriate, based on the incoming signal and its internal state. In order to respond by replying, IC 1124 modulates the reflectance of the antenna, which generates the backscatter from a wave transmitted by the reader. Coupling together and uncoupling the antenna ports of IC 1124 can modulate the reflectance, as can a variety of other means.

In the embodiment of FIG. 11, antenna segments 1127 are separate from IC 1124. In other embodiments, antenna segments may alternately be formed on IC 1124, and so on.

The components of the RFID system of FIG. 10 may communicate with each other in any number of modes. One such mode is called full duplex. Another such mode is called half-duplex, and is described below.

Figure 12:
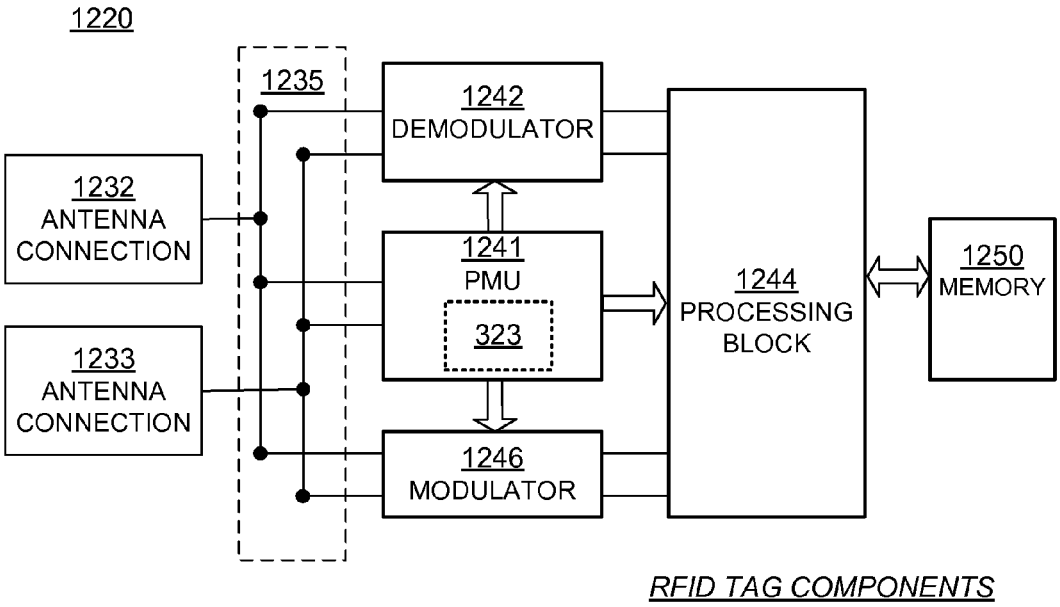
FIG. 12 is a block diagram of an implementation of an electrical circuit of a passive RFID tag, such as the one shown in FIG. 11.

FIG. 12 is a block diagram of an electrical circuit 1220. Circuit 1220 may be formed in an IC of an RFID tag, such as IC 1124 of FIG. 11. Circuit 1220 has a number of main components that are described in this document. Circuit 1220 may have a number of additional components from what is shown and described, or different components, depending on the exact implementation.

Circuit 1220 includes at least two antenna connections 1232, 1233, which are suitable for coupling to one or more antenna segments (not shown in FIG. 12). Antenna connections 1232, 1233 may be made in any suitable way, such as pads and so on. In a number of embodiments more than two antenna connections are used, especially in embodiments where more antenna segments are used.

Circuit 1220 includes a section 1235. Section 1235 may be implemented as shown, for example as a group of nodes for proper routing of signals. In some embodiments, section 1235 may be implemented otherwise, for example to include a receive/transmit switch that can route a signal, and so on.

Circuit 1220 also includes a Power Management Unit (PMU) 1241. PMU 1241 may be implemented in any way known in the art, for harvesting raw RF power received via antenna connections 1232, 1233. In some embodiments, PMU 1241 includes at least one rectifier, and so on.

In operation, an RF wave received via antenna connections 1232, 1233 is received by PMU 1241, which in turn generates power for components of circuit 1220. This is true for either or both R→T and T→R sessions, whether or not the received RF wave is modulated.

The PMU 1241 may include the reference current generator circuit 323 of FIG. 3 or any other reference current generator circuit described in previous embodiments, or modified by a person skilled in the art, to generate reference currents substantially independent of temperature variations. The reference current generator circuit 323 may supply current to power the PMU 1241.

Circuit 1220 additionally includes a demodulator 1242. Demodulator 1242 demodulates an RF signal received via antenna connections 1232, 1233. Demodulator 1242 may be implemented in any way known in the art, for example including an attenuator stage, amplifier stage, and so on.

Circuit 1220 further includes a processing block 1244. Processing block 1244 receives the demodulated signal from demodulator 1242, and may perform operations. In addition, it may generate an output signal for transmission.

Processing block 1244 may be implemented in any way known in the art. For example, processing block 1244 may include a number of components, such as a processor, memory, a decoder, an encoder, and so on.

Circuit 1220 additionally includes a modulator 1246. Modulator 1246 modulates an output signal generated by processing block 1244. The modulated signal is transmitted by driving antenna connections 1232, 1233, and therefore driving the load presented by the coupled antenna segment or segments. Modulator 1246 may be implemented in any way known in the art, for example including a driver stage, amplifier stage, and so on.

In one embodiment, demodulator 1242 and modulator 1246 may be combined in a single transceiver circuit. In another embodiment, modulator 1246 may include a back-scatter transmitter or an active transmitter. In yet other embodiments, demodulator 1242 and modulator 1246 are part of processing block 1244.

Circuit 1220 additionally includes a memory 1250. Memory 1250 is preferably implemented as a Non-Volatile Memory (NVM), which means that data is retained, even when circuit 1220 does not have power, as is frequently the case for a passive RFID tag.

It will be recognized at this juncture that the components of circuit 1220 can also be those of a circuit of an RFID reader according to the invention, without needing PMU 1241. Indeed, an RFID reader can typically be powered differently, such as from a wall outlet, a battery, and so on. Additionally, when circuit 1220 is configured as a reader, processing block 1244 may have additional Inputs/Outputs (I/O) to a terminal, network, or other such devices or connections.

Figure 13:
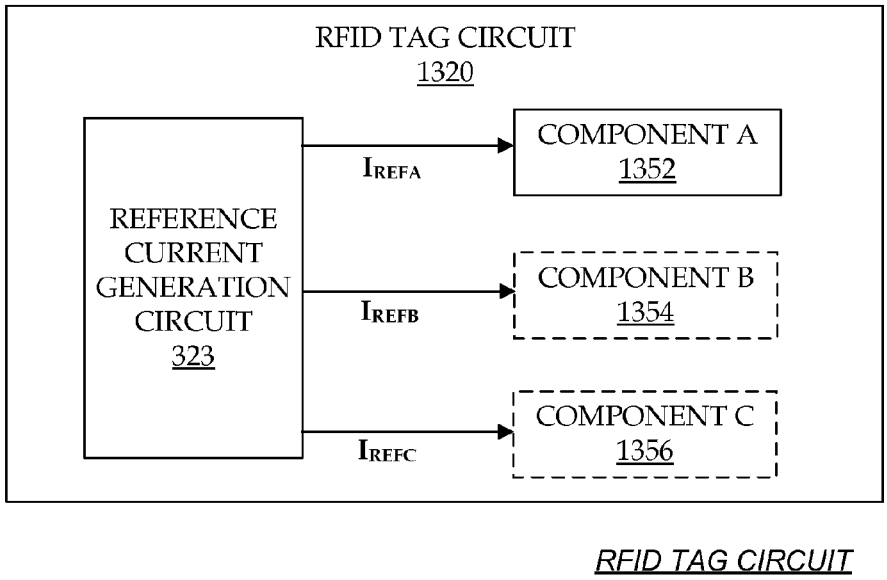
FIG. 13 is a block diagram of a tag circuit that includes the reference current generation block of FIG. 3 according to an embodiment.

FIG. 13 is a block diagram of a tag circuit 1320 that includes the reference current generator circuit 323, 923 of FIGS. 3 and 9, according to an embodiment. The reference current generator circuit 323, 923 may be implemented in any way previously described to generate a reference current $I_{REFA}$ supplied to power a component A 1352 in the tag circuit 1320. Component A may be the PMU 1241, the demodulator 1242, other components that may be in the processing block 1244, such as an oscillator, a persistent bit circuit or an analog random number generator, or any other component shown or not shown in FIG. 12, and contained in the tag circuits 1220, 1320.

Additionally, more than one reference current, $I_{REFA}$, $I_{REFB}$, $I_{REFC}$, may be generated by the reference current generation circuit 323 to optionally supply currents simultaneously to more than one component, such as to component A 1352, component B 1354 and component C 1356. Component A 1352, component B 1354 and component C 1356 may be any component in the tag circuit 1320 that require power or biasing for operation, such as the tag components previously described.

Embodiments of the invention also include methods. Some are methods of operation of a reference current generator circuit, a reference current generator system, an RFID tag or RFID tag system. Others are methods for controlling such reference generator circuits or RFID tag system.

These methods can be implemented in any number of ways, including the structures described in this document. Methods are now described more particularly according to embodiments.

Figure 14:
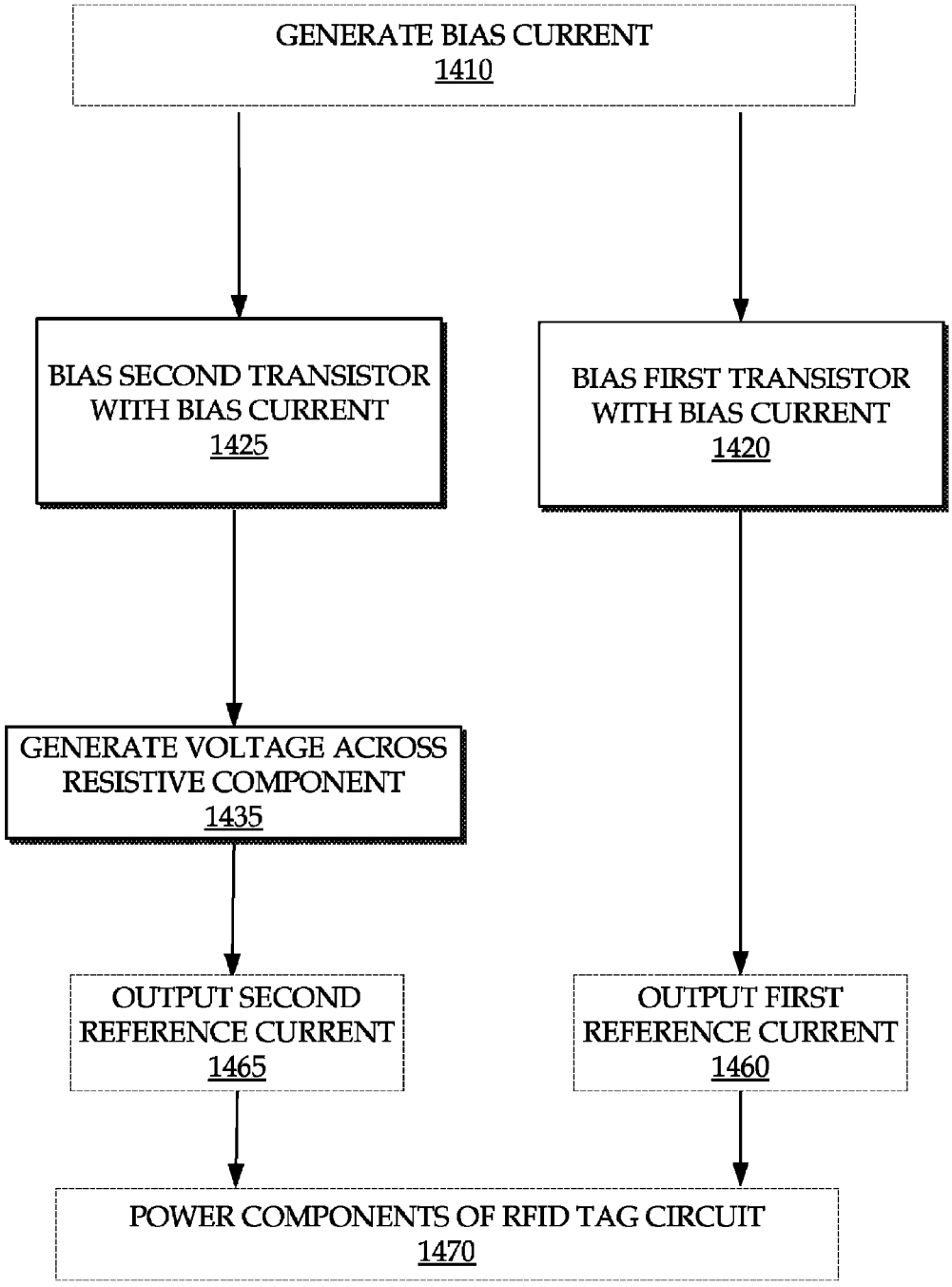
FIG. 14 is a flow diagram illustrating a method for generating reference currents substantially independent of temperature according to embodiments.

FIG. 14 is a flow diagram illustrating a method for generating reference currents substantially independent of temperature according to embodiments. According to an operation step 1410, one or more currents may be generated, such as a bias current, to source a first current, as shown in a next operation step 1420, through the first transistor 314 in a first current path. The first transistor 314 has a first gate-to-source voltage that is determined by a first threshold voltage. The bias current provided in the step 1410 may be optional, and can be implemented a number of ways, such as the bias circuit embodiments previously described. The bias circuit embodiments may optionally receive an initial current from a start-up circuit (not shown) that initializes the generation of the one or more currents in step 1410.

According to a next operation step at 1425, a second current from the bias current is sourced through the second transistor 319 in a second current path. The second current is conducted through the second transistor 319 having a second gate-to-source voltage determined by a threshold voltage different from the threshold voltage of the first transistor 314.

The threshold voltage of the second transistor 319 may be different from the threshold voltage of the first transistor 314 by at least 10%.

According to another operation step at 1435, a voltage is generated across the resistive component 316, thereby driving a current through the resistive component 316. The voltage drop across the resistive component 316 may be generated a number of ways, as described in previous embodiments, such as by the voltage differential generated between the gate-to-source voltages of the transistors 314, 319. The different threshold voltages are set such that the temperature coefficient of the second transistor 319 is substantially matched to the temperature coefficient of the first transistor 314. Therefore, the second temperature coefficient substantially compensates for the first temperature coefficient. As a result, the voltage across the resistive component 316 is relatively independent of temperature.

According to an optional step at 1460 the first current sourced through the first transistor 314 may be mirrored to output a first reference current in any way known in the art. Additional reference currents may be generated, by mirroring multiple reference currents from the first current.

Alternatively, according to an optional step at 1465, additional reference currents may be generated by mirroring the current through the resistive component 316 to output a second reference current. The second reference current may also be mirrored to generate multiple mirror currents.

According to an optional operation step at 1470, multiple reference currents may be provided to power components of an RFID tag circuit. For example, one of the reference currents may be utilized to power the PMU 1241 of FIG. 12. Multiple reference currents may be utilized to supply a bias current to multiple tag circuit components simultaneously, such as to the demodulator, the random number generator, the persistent bit circuit, the oscillator, and other tag components, as previously described.

In this description, numerous details have been set forth in order to provide a thorough understanding. In other instances, well-known features have not been described in detail in order to not obscure unnecessarily the description.

A person skilled in the art will be able to practice the present invention in view of this description, which is to be taken as a whole. The specific embodiments as disclosed and illustrated herein are not to be considered in a limiting sense. Indeed, it should be readily apparent to those skilled in the art that what is described herein may be modified in numerous ways. Such ways can include equivalents to what is described herein.

The following claims define certain combinations and subcombinations of elements, features, steps, and/or functions, which are regarded as novel and non-obvious. Additional claims for other combinations and subcombinations may be presented in this or a related document.

What is claimed is:

1. A reference current generation circuit for a Radio Frequency Identification (RFID) tag, comprising:

a first current path for a first current, and a second current path for a second current;

a first transistor in the first current path adapted to conduct the first current, the first transistor having a first threshold voltage;

a second transistor in the second current path adapted to conduct the second current as a function of the first current, the second transistor having a second threshold voltage different by at least 10% from the first threshold voltage; and a resistive component coupled in series with the second transistor in the second current path, wherein the reference current generation circuit provides a reference current to at least one from a set of: a power management unit (PMU), a demodulator, an oscillator, a persistent bit circuit, and an analog random number generator of the RFID tag.

2. The reference current generation circuit of claim 1, in which the second threshold voltage is less than the first threshold voltage.

3. The reference current generation circuit of claim 1, in which the voltage across the resistive component is substantially equal to the difference between a gate-to-source voltage of the first transistor and a gate-to-source voltage of the second transistor.

4. The reference current generation circuit of claim 1, in which the first transistor has a first temperature coefficient, the second transistor has a second temperature coefficient, and the second temperature coefficient substantially compensates for the first temperature coefficient such that a voltage across the resistive component is maintained substantially constant over a temperature range of at least 30 degrees Celsius.

5. The reference current generation circuit of claim 1, further comprising:

a mirror circuit coupled to one of the first current path and the second current path, the mirror circuit operable to output the reference current relative to the current in the respectively coupled one of the first and the second current paths.

6. The reference current generation circuit of claim 1, further comprising:

a start-up circuit coupled to the first path, and operable to provide a start-up current.

7. The reference current generation circuit of claim 1, further comprising:

a bias circuit coupled to the first current path and operable to source the first current.

8. The reference current generation circuit of claim 7, in which the bias circuit includes an amplifier circuit.

9. The reference current generation circuit of claim 7, in which the bias circuit includes a transconductance amplifier circuit.

10. A method for generating a reference current for a Radio Frequency Identification (RFID) tag, comprising:

generating a bias current;

biasing a first transistor with the bias current to generate a first gate-to-source voltage, the first transistor having a first threshold voltage;

biasing a second transistor to conduct a second current determined by the first gate-to-source voltage, the second transistor having a second gate-to-source voltage and a second threshold voltage different by at least 10% from the first threshold voltage;

generating a voltage across a resistive component, the generated voltage determined by a voltage differential between the gate-to-source voltages of the first and second transistors; and providing a reference current generated relative to one of the first current and the second current to at least one from a set of: a power management unit (PMU), a demodulator, an oscillator, a persistent bit circuit, and an analog random number generator of the RFID tag.

11. The method of claim 10, in which the first transistor has a first temperature coefficient, the second transistor has a second temperature coefficient, and the second temperature coefficient substantially compensates for the first temperature coefficient such that a voltage across the resistive component is maintained substantially constant over a temperature range of at least 30 degrees Celsius.

12. The method of claim 10, in which the bias current is generated by a bias circuit.

13. The method of claim 12, further comprising:

providing an initial current from a start-up circuit to the bias circuit to generate the bias current.

14. The method of 12, further comprising:

adjusting the magnitude of the drain currents in the bias-circuit transistors by an amplifier.

* * * * *

UNITED STATES PATENT AND TRADEMARK OFFICE

CERTIFICATE OF CORRECTION

PATENT NO. : 7,768,248 B1
APPLICATION NO. : 11/981397
DATED : August 3, 2010
INVENTOR(S) : Hyde et al.

It is certified that error appears in the above-identified patent and that said Letters Patent is hereby corrected as shown below:

1) Col. 14, line 6 in Claim 14, please delete "12," and insert -- claim 12, --, therefor.

Signed and Sealed this
Fifth Day of April, 2011

David J. Kappos

David J. Kappos
*Director of the United States Patent and Trademark Office*